US007426898B1

(12) United States Patent
Ahern

(10) Patent No.: US 7,426,898 B1
(45) Date of Patent: Sep. 23, 2008

(54) FLOATING BERTH MODULAR DOCK SYSTEM ASSEMBLY

(76) Inventor: Roy Ahern, 1120 Front St., Hudson, WI (US) 54016

( * ) Notice: Subject to any disclaimer, the term of this patent is extended or adjusted under 35 U.S.C. 154(b) by 0 days.

(21) Appl. No.: 11/266,145

(22) Filed: Nov. 3, 2005

Related U.S. Application Data

(63) Continuation-in-part of application No. 10/779,477, filed on Feb. 12, 2004, now Pat. No. 7,213,531.

(51) Int. Cl.
*B63B 35/44* (2006.01)

(52) U.S. Cl. ..... 114/263; 114/267

(58) Field of Classification Search ..... 114/258, 114/259, 263, 264, 266, 267, 44–48; 405/1–7, 405/218–220; D12/316
See application file for complete search history.

(56) References Cited

U.S. PATENT DOCUMENTS

| | | | | |
|---|---|---|---|---|
| 3,788,254 | A * | 1/1974 | Sheil | 114/266 |
| 3,824,644 | A | 7/1974 | Stranzinger | |
| 4,604,962 | A | 8/1986 | Guibault | |
| 5,251,560 | A * | 10/1993 | Ban et al. | 114/266 |
| 5,529,013 | A | 6/1996 | Eva, III et al. | |
| 5,682,833 | A | 11/1997 | Eva, III et al. | |
| 5,931,113 | A * | 8/1999 | Eva et al. | 114/263 |
| 5,941,660 | A | 8/1999 | Rueckert | |
| 5,947,049 | A | 9/1999 | Elson | |
| 5,947,050 | A | 9/1999 | Eva, III et al. | |
| 6,033,151 | A | 3/2000 | Tsou | |
| 6,138,599 | A | 10/2000 | Elson | |
| 6,431,106 | B1 * | 8/2002 | Eva et al. | 114/263 |
| 6,526,902 | B1 * | 3/2003 | Faber | 114/263 |
| 6,745,714 | B1 * | 6/2004 | Faber | 114/263 |
| D508,453 | S * | 8/2005 | Ahern | D12/317 |

FOREIGN PATENT DOCUMENTS

| | | | |
|---|---|---|---|
| JP | 55059082 | A * | 5/1980 |
| JP | 2001071991 | A * | 3/2001 |

* cited by examiner

*Primary Examiner*—Ajay Vasudeva
(74) *Attorney, Agent, or Firm*—Robert A. Elwell

(57) ABSTRACT

A floating boat lift has a platform, first and second parallel spaced apart arms and a boat holding region defined therebetween, the defined boatholding region having a linking strip of half-blocks with an aligned groove for accepting and guiding a boat keel. The lift includes adjustable buoyancy.

18 Claims, 13 Drawing Sheets

FLOATING BERTH MODULAR DOCK SYSTEM ASSEMBLY

This application is a continuation-in-part of Ser. No. 10/779,477, filed Feb. 12, 2004 and entitled "Multidirectional Floating Dock Element" now U.S. Pat. No. 7,213,531. This invention is directed to floating docks and, in particular, to a multidirectional floating dock element especially suited for assembly of floating docks, drive-on docks and floating decks.

BACKGROUND OF INVENTION

In the past modular floating docks have been created by the assembly of a number of floating subunits. These subunits include various geometric shapes with planar upper and lower surfaces. The subunits connect together to create docks and walkways having various shapes and sizes based on the consumers needs.

For example, U.S. Pat. Nos. 6,138,599 and 5,947,049 teach a buoyant walkway module for a boatlift. The device includes a plurality of elongated compartments having planar top and bottom surfaces. The device also includes planar ends for connecting the walkways together in an end to end relationship.

U.S. Pat. No. 5,251,560 teaches a water-float coupling device for coupling together hexagonally shaped floats having planar upper and lower surfaces.

U.S. Pat. No. 6,033,151 teaches a float unit having planar upper and lower surfaces and corrugated side surfaces. The corrugated side surfaces engage with adjacent floats to provide friction between the units.

U.S. Pat. Nos. 3,824,644 and 4,604,962 teach a substantially prismatic, floating element having rounded corner edges. The elements are provided with outwardly projecting eye lugs for attachment to adjacent elements. These elements are typically provided with bungholes to allow partial flooding of some or all of the units to lower their water line.

It is also known in the prior art to construct floating drive-on type docks. The docks are assembled from floating elements having various geometric shapes to create a dock which allows a boat operator to drive his/her boat directly onto the upper surface of the dock using the boats power.

For example, U.S. Pat. No. 5,941,660 teaches a watercraft support structure formed from a plurality of large rigid platforms that are coupled together by linking pins or insertion plugs. The structure includes multiple ramp, cradle, and flat platforms.

These devices work relatively well for docking large watercraft however, the upwardly extending hull guides and cylindrically shaped upper surface make these devices generally unsuitable for dual use as decks or walkways.

Other floating drive-on docks of the prior art are constructed of cubical subunits with tabs projecting from the vertical edges at or near the horizontal midline for attachment to adjacent units. The units have planar upper surface and lower surfaces. The floating units are provided with a gripping texture on one side and thus, are generally designed to be oriented only with the gripping surface upward.

For example, U.S. Pat. Nos. 5,529,013, 5,682,833, 5,947,050, 6,431,106 and 5,931,113 teach a floating drive-on dock assembled using the parallelepiped shaped units. The docks generally consist of two arms (single rows) of hollow and airtight floatation units. The arms each consist of three large cubes at the inward portion and three small cubes mounted at the distal end. Between the arms is an area open to the water surface. At the distal end of the two arms a floatation unit is utilized to connect the arms together to prevent the arms from spreading apart as a craft is driven onto the arms.

While these designs are functional, they have numerous shortcomings that have not been addressed in the art. For example, in order to provide guidance for the boat hull when used for drive-on docking, the planer surfaced cubes must be spaced apart leaving an open center between the two arms. The open center does not provide sufficient guiding for several types of boat hulls.

In addition, the narrow width of the arms, the lack of connection to floatation units on tour sides, the open center, and the low buoyancy of the small cubes make these structures extremely unstable for pedestrian traffic and unsuitable for decks or walkways. This safety hazard is magnified when the docks are used at night.

Still further, the open nature of these docks combined with the wave action associated with large bodies of water often results in repeated splashing of water into the drive units of the docked watercraft and thus causes premature failure of important components of the watercraft drive system. Keeping a watercraft high and dry when not in use is important to protecting the machinery of the craft. This is particularly true of jet type propulsion systems and is critical when the craft is docked in salt water.

Thus, what is needed in the art is a modular docking element that is adapted for assembly into walkways, decks and drive-on docks to provide increased versatility and safety. The element should be multidirectional, having a surface specific to drive-on docking on one face and a surface specific to decks and walkways on a second face. Each of these faces should provide a surface which allows a watercraft to slide easily for drive-on docking without hull damage, while providing superior grip for pedestrian traffic. The floating element should also accommodate utilities, e.g. water and electricity throughout the dock and/or walkway when assembled. The assembled floating elements should also accommodate rigid members wherever they are needed throughout the dock to change the flex and buoyancy characteristics of the dock. Each individual floating element should optionally allow ballast to be added to alter the height, buoyancy and stability of an assembled dock or walkway.

SUMMARY OF THE INVENTION

The present invention provides a multidirectional floating element. The multidirectional floating element is preferably a polyhedron in overall shape including a first generally planar surface adapted for use as a deck, a second surface having a V-shaped channel adapted for receiving and guiding a watercraft hull, and a plurality of side walls for adjoining and maintaining spacing between the first surface and the second surface. The V-shaped channel extends across the center portion of the element and preferably includes two generally parallel and planar surfaces spaced apart and connected by a generally planar lower surface. The two generally parallel and planar surfaces diverge outwardly at predetermined angles to cooperate with a boat keel when used for drive-on docking.

The first surface, second surface and the plurality of side walls are formed of polymeric material(s) by conventional methods well known in the art. Using these methods, the first surface, second surface and side walls may be formed continuous or they may include at least one aperture therethrough. In the preferred embodiment the aperture is constructed and arranged to allow the buoyancy of the floatation element to be altered by the addition of ballast. Cooperating with the aperture is one of a variety of caps or plugs. The cap may be constructed and arranged to maintain air tightness within the floatation element or the cap may be adapted to include a vent, allowing air and/or water to flow inwardly and outwardly from within the floatation element upon a predetermined pressure.

The floatation element also includes connection means adapted for linking adjacent flotation elements together. The connection means may be arranged so that the uppermost surfaces of the adjacent floatation elements are substantially coplanar, or so that the uppermost surfaces of adjacent floatation elements are vertically offset and generally parallel to create an upper surface and a lower surface.

Preferably the connection means include a plurality of horizontally projecting tabs, each including at least one aperture therethrough. The aperture is constructed and arranged to cooperate with at least one horizontally projecting tab of an adjacent flotation element. In a most preferred embodiment the horizontally projecting tabs extend generally from intersecting corners of the side walls at different vertical levels for overlapping cooperation with horizontally projecting tabs of adjacent floatation elements while maintaining a planer upper surface. In alternative embodiments the horizontally projecting tabs may be offset closer to the first surface or the second surface to permit offset and generally parallel upper surfaces and lower surfaces with respect to adjacent floatation elements.

In alternative embodiments the floatation elements may be formed in various other polyhedral shapes that are adapted to fit together suitably for use as floating walkways, docks or decks. Some of these shapes may include, but should not be limited to rectangles, squares, pentagons, hexagons, octagons and the like.

In other alternative embodiments at least one, and preferably two, of the side walls include an integrally formed semi-circular conduit extending the length of the floatation element; the semi-circular conduit being constructed and arranged to cooperate with semi-circular conduits of adjacent floatation elements to create a generally circular conduit extending through assembled decks, walkways or docks. The conduit is adapted for providing a pathway for service utilities throughout adjacent assembled floatation elements. In this manner service utilities such as electricity and water may be utilized throughout the assembled floatation elements. The circular conduit may also be utilized for insertion of rigid or semi-rigid members for altering the flex and buoyancy characteristics of the assembled floatation elements.

Thus, it is an objective of the instant invention to provide a modular multidirectional floating element for use in assembling walkways, decks and docks.

Another objective of the instant invention is to provide a multidirectional floating element having a first planar surface, a second watercraft keel guiding surface and a plurality of sidewalls that are continuously formed.

A further objective of the instant invention is to provide a vented multidirectional floating element having a first planar surface, a second watercraft keel guiding surface and a plurality of sidewalls.

An additional objective of the instant invention is to provide a multidirectional floating element which can be assembled into a deck-like drive-on dock assembly that provides increased safety by not requiring open wells or gaps between floatation elements for drive-on operation.

Yet another objective of the instant invention is to provide a multidirectional floating element which can be assembled into a floating dock or walkway assembly having a utility conduit.

Still another objective of the instant invention is to provide a multidirectional floating element which can be assembled into a floating dock assembly having a conduit for stiffening members.

Still yet another objective of the instant invention is to provide a multidirectional floatation element having a planer surface that can be utilized for decks and walkways and a contoured surface which can be utilized for guiding the keel of a watercraft onto a drive-on dock assembly.

Still yet another objective of the instant invention is to provide a kit for use with pre-existing drive-on dock structures for increasing the safety thereof.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

In yet another preferred alternative embodiment, the present invention concerns, in part, a rectangular float module. By rectangular float module herein is meant a buoyant object, which has a substantially planar upper surface, typically suitable for walking upon, the substantially planar upper surface having a horizontal length, and a horizontal width, with the horizontal length exceeding the horizontal width. Preferably, the ratio of horizontal length to horizontal width is an integer ratio, such as for example 2:1, 3:1, and 4:1. Larger ratios than 4:1 while useable, are less desirable, in that shipping and handling become progressively difficult while the rigidity and stability increases imparted to an assembly, as will be understood from the explanation herein, are far less dramatic improved relative to the advantages seen from utilizing ratios in the range of 2:1 to 4:1. While ratios smaller than 2:1 might be used, the advantages of a rectangular floats diminishes dramatically below the fractional ratio of about 1.5:1. It should also be understood that a traditional "square" float modules, having a ratio of 1:1 are not a "rectangular" float modules and accordingly do not provide the advantages in an assembly provided by a "rectangular" float module. Below the substantially planar upper surface, typically a walking surface, is a float body. Preferably the float body has rounded corners and preferably may be segmented. In a particularly preferred embodiment, a 2:1 ratio rectangular float module has a float body with two roughly equal float body segments, each of the segments having rounded bottom corners. The depth of the float body may vary from deeper than the horizontal width to shallower than the horizontal width, however, for ease of explanation and to facilitate understanding, float body depth may be considered to be about the same as the horizontal width. Overall, the most preferred 2:1 ratio rectangular float module has a vertical plane of generally bilateral symmetry defined at a midpoint of the horizontal length. Six connecting tabs, each with an aperture, are present and may be bilaterally symmetrical or may not be bilaterally symmetrical depending upon the depth, relative to the planar top, of the level from which such tabs horizontally project. To aid in understanding, the invention is explained in terms of the most preferred float module having a 2:1 ratio between length and width. To begin then, the rectangular float module, to be used in the assembly of this invention, may be rudimentarily and initially considered similar to a double float (i.e. initially considered to appear to be two traditional cubic floats with corner tabs, wherein two corner tabs of each of the traditional cubic floats are joined.) However, due to a more rigid relationship between the two partnered traditional cube-like floats than would be present from a mere tab connection of traditional cube-like floats, it is important to recognize that substantially less flex or bending is present between the two partnered traditional cube-like floats. Such more rigid relationships between two traditional cubic floats can be provided in many ways. Arguably some of these ways were previously well within the skill of the prior art. For example, adding and linking additional tabs at another elevation level, or adding permanent linking panels or braces or stiffener devices in addition to or instead of using tabs and fasteners can achieve such a more rigid double unit, if there was a recognized need for such a stiff, substantially inflexible rectangular float module unit. Alternatively, the integral semi-circular conduits earlier mentioned with respect to altering the flex between two units of the earlier described embodiment of the present invention provides another, more novel method of obtaining a double unit with substantially reduced flex. Thus, it is the more rigid relationship in a non-cubic, preferably rectangular float, and most preferably rectangular relatively rigid float, and most particularly those with roughly 2:1 ratio of length to width that is a significant component in the alternative embodiment to be described herein.

In particular, the alternative embodiment is a floating berth modular dock system assembly including a first berth side run and a keel guide and support. The first berth side run has a longitudinal extent and a transverse extent. The first berth side run includes a plurality of rectangular float modules. Each of these rectangular float modules has two sides with a horizontally oriented width between the two sides and two ends with a horizontally oriented length between the two ends. As might be expected for a rectangle, in contrast to a square, the horizontally oriented length exceeds the horizontally oriented width. The plurality of rectangular float modules are organized in at least two longitudinally directed courses of rectangular float modules. Each longitudinally directed course of the at least two longitudinally directed courses has adjoining rectangular float modules joined by end-to-end junctions. Each of the at least two longitudinally directed courses are parallel to and longitudinally offset from adjoining courses, such that end-to-end junctions in one course do not align with end-to-end junctions in adjoining courses. The keel guide and support also has a longitudinal extent and a horizontal extent. The keel guide and support includes a plurality of modular keel guide and support floats joined in a longitudinally co-aligned orientation. The keel guide and support might be understood by considering, for example, the earlier mentioned kit embodiment. The keel guide and support are connected to the first berth side run with the longitudinal extent of the keel guide and support oriented parallel to the longitudinal extent of the first berth side run.

Preferably, the floating berth modular dock system assembly also includes a second berth side run. The second berth side run has a longitudinal extent and a transverse extent. This second berth side run also includes a plurality of rectangular float modules. Each of the rectangular float modules has two sides with a horizontally oriented width between the sides and two ends with a horizontally oriented length between the two ends, and again, the horizontally oriented length exceeds the horizontally oriented width. This plurality of rectangular float modules are organized in at least two longitudinally directed courses of rectangular float modules. Each of the longitudinally directed courses have adjoining rectangular float modules joined by end-to-end junctions. Each of the at least two longitudinally directed courses are parallel to and longitudinally offset from adjoining courses, such that end-to-end junctions in one course do not align with end-to-end junctions in adjoining courses. The longitudinal extent of the second berth side run is oriented parallel to the longitudinal extents of the first berth side run and of the keel guide and support, with the keel guide and support interposed between the first berth side run and the second berth side run. Preferably, the floating berth modular dock system assembly includes a platform, the platform is connected to the first berth side run, the second berth side run and the keel guide and support interposed between the first berth side run and second berth side run.

Preferably, the platform also includes a plurality of modular rectangular floats and at least one set of the at least two longitudinally directed and longitudinally offset courses of modular rectangular floats extend into the plurality of modular rectangular floats of the platform. More preferably, both sets of longitudinally directed and longitudinally offset courses extend into the platform and further at least one additional course of longitudinally offset rectangular float modules is interposed between and longitudinally offset relative to the courses extending from the first berth side run and the second berth side run. Preferably, the rectangular floating modules have at least one horizontally projecting tab having at least one aperture extending, between the ends of rectangular module, from a side of the rectangular floating module so as to allow formation of junctions connecting rectangular floating modules and modular keel guide and support floats. For watercraft of greater beam or where addition space is desired to travel about a watercraft supported on the assembly, at least one of the first berth side run and the second berth side run include at least three longitudinally directed courses of rectangular modular floats, each longitudinally offset relative to adjoining longitudinally directed courses. Preferably, each of the modular keel guide and support floats has four sides and a horizontally oriented extent in both width and length similar to the horizontally oriented width of the rectangular float modules. Most preferably, these keel guide and support floats are about 18 to 20, and most especially about 19 inches on an end. In yet another variation, it should be understood that the keel and guide support floats need not have a horizontally square profile but could also have a rectangular profile as long as they also have a longitudinally orientable groove.

In yet another embodiment, the present invention is a floating berth modular dock system assembly including a first side run, a second side run, and a keel guide and support. In this embodiment, the first and second side runs are each characterized, when separated from the assembly, by a greater tendency to longitudinally flex in a first (for example, concave) manner than in a second (for example, convex) manner and the keel guide and support is characterized, when separated from the assembly, by a greater tendency to longitudinally flex in the second (for example, convex) manner than in the first (for example, concave) manner, and wherein the assembly is characterized by reduced tendency to longitudinally flex than any of the first side run, the second side run, and the keel guide and support, when such sub-parts are separated from the assembly. In understanding this embodiment, the first (for example, concave) manner of longitudinal flexing should be understood as the center of a floating longitudinally extended component deflecting or bowing or bending downwardly toward submerging, while the ends remain generally unmoved. The second (for example, convex) manner of longitudinal flexing should be understood as the ends of a floating longitudinally extended component deflecting or bowing or bending downwardly toward submerging, while the center remains generally unmoved. Further, it should be understood that the side runs and the keel guide and support, when combined, tend to act together to stiffen the assembly. That is, each assembly sub-part (i.e. the side runs and the keel guide and support), tends to be limited in its tendency to flex by the properties of adjacent sub-parts. Therefore, the keel guide and support tends to become limited in its tendency to second (for example, convex) manner of flexing to the properties of the side runs. Similarly, the side runs tend to become limited in their tendency to first (for example, concave) manner of flexing to the properties of the keel guide and support. Thus, the assembly is more rigid than its component sub-parts.

In still another embodiment, the present invention is a method of assembling a floating berth modular dock system. In this method, the earlier mentioned parts are provided and then assembled to result in the useful assembly described above. Preferably, the side runs are assembled first and the keel guiding and support is added and interposed between the side runs. Preferably, a platform is present, and most preferably, the longitudinally offset courses extend into the platform from one side run and meet with the courses extending in from the opposite side run, retaining the longitudinal offset relationship.

DETAILED DESCRIPTION OF THE INVENTION

Figure 1:
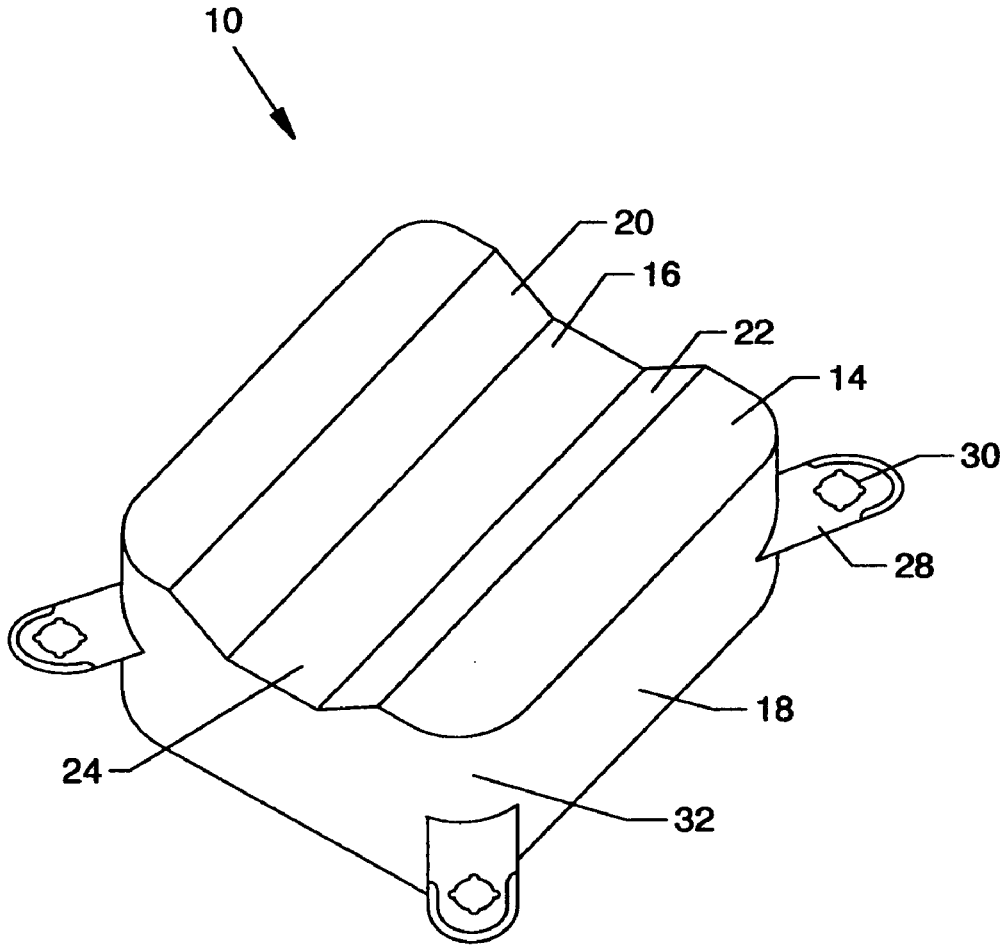
FIG. 1 is a pictorial view showing the watercraft guiding surface of the instant invention.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and described in the specification.

Figure 2:
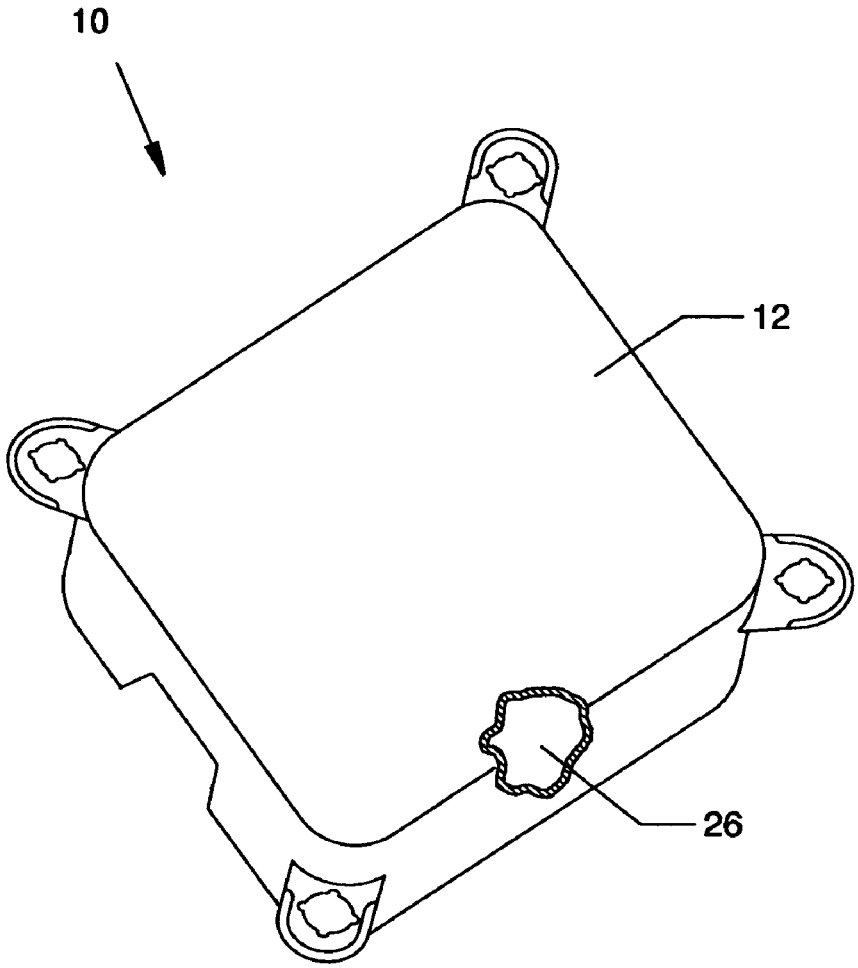
FIG. 2 is a pictorial view, partially in section, showing the planer surface of the instant invention as well as the internal cavity.

With reference to FIGS. 1 and 2, the instant invention provides a multidirectional floating element 10. The floating element 10 in its preferred embodiment is a polyhedron in overall shape, including a first generally planar surface 12, a second guiding surface 14 having a Vshaped channel 16 and a plurality of side walls 18 for adjoining and maintaining spacing between the first surface and the second surface. In operation, the first surface 12 is generally arranged to face upwardly for use in constructing floating walkways, floating decks and the like. The second surface 14 is generally arranged to face upwardly for use in constructing a portion of a drive-on dock assembly to provide precise guiding to the keel portion of a watercraft. The guiding surface is illustrated herein in a non-limiting embodiment as a V-shaped channel 16 extending across the center portion of the floatation element 10 including two generally parallel and planar surfaces 20, 22 spaced apart and connected by a generally planar lower surface 24. The two generally parallel and planar surfaces diverge outwardly at predetermined angles to cooperate with a boat keel for use in drive-on docking. In this manner a precise guiding surface is provided for boats having a variety of hull shapes. It should also be appreciated that other contoured surface shapes may be employed without departing from the scope of the instant invention. The multidirectional floatation elements may be formed in various sizes to provide the needed buoyancy for various applications. In the preferred embodiment the multidirectional floatation elements are about 19 inches across when viewed from the top and between about 8 inches and 20 inches in height when viewed from the side.

Figure 3:
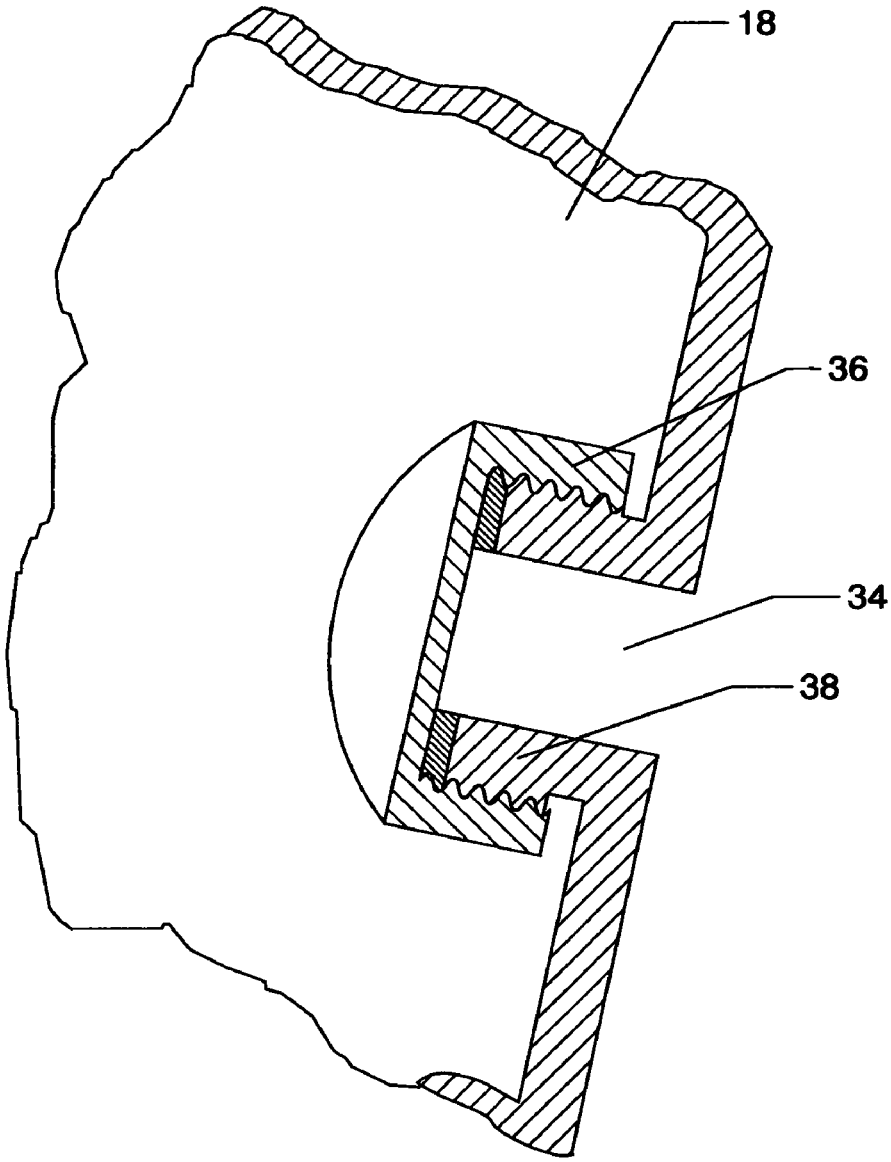
FIG. 3 is a partial section view illustrating the aperture and cap arrangement for venting and ballast control of the instant invention.

Referring to FIGS. 1 through 3, the first surface 12, second surface 14 and the plurality of side walls 18 are formed of polymeric material(s) by conventional methods well known in the art, e.g. blow molding, roto-molding, injection molding and the like. Using these methods the first surface 12, second surface 14 and side walls 18 may be formed continuous or they may include at least one aperture 34 therethrough. In the preferred embodiment the aperture 34 includes a tubular stem 38 constructed and arranged to allow the buoyancy of the floatation element to be altered by the addition of ballast, e.g. water, sand, metal shot and the like to the internal cavity 26 of the floatation element. Cooperating with the aperture 34 is one of a variety of caps 36. The cap 34 may be constructed and arranged for threaded engagement with the tubular stem 38 to maintain air tightness within the floatation element 10 or the cap 34 may be adapted to include a vent (not shown), allowing air and/or water to flow inwardly and outwardly from within the floatation element internal cavity 26 upon a predetermined pressure.

Figure 4:
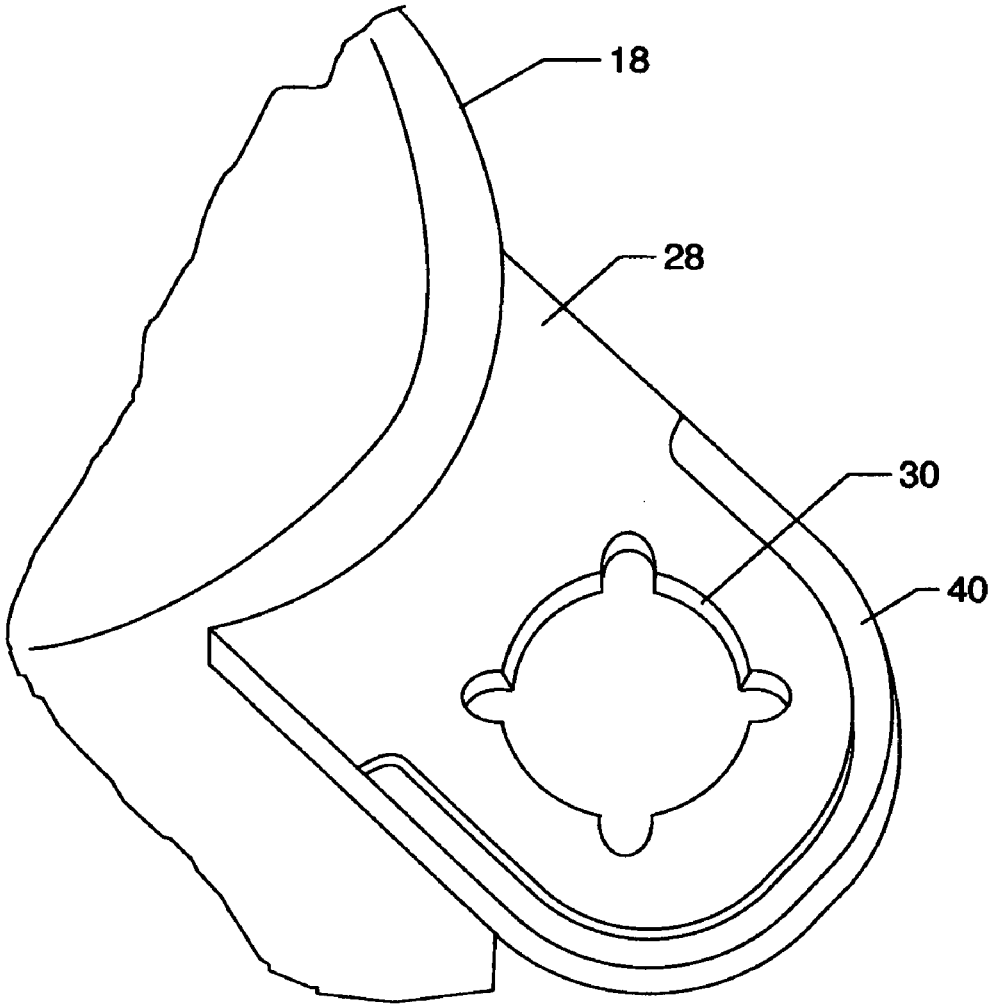
FIG. 4 is a partial pictorial view of the connection means utilized in the instant invention.

Referring to FIG. 4, the floatation element 10 also includes connection means illustrated herein as a plurality of horizontally projecting tabs 28 each including at least one fastening aperture 30. The tabs 28 are preferably arranged to extend generally from intersecting corners 32 (FIG. 1) of the side walls 18 at different vertical levels between the first and second surfaces for overlapping cooperation with horizontally projecting tabs of adjacent floatation elements, so that the uppermost surfaces of adjacent floatation elements are substantially coplanar. Alternatively, the tabs 28 may be offset closer to the first surface or the second surface, so that the uppermost surfaces of adjacent floatation elements are vertically offset and generally parallel (FIG. 7) with respect to each other for a stepped configuration having an upper surface 46 and a lower surface 48. In this manner assemblies such as stairs and watercraft hull supports may be created. In addition, this construction may be utilized to vary the flexing characteristics of assemblies constructed from the floatation elements.

Still referring to FIG. 4, the tabs are also preferably constructed to include a tongue member 40 along the perimeter of the tabs 28. The tongue member 40 is constructed and arranged to cooperate with fastener components having a cooperating groove attached thereto, such as threaded nuts or bayonet receivers and the like, to hold the components in place during assembly of floatation elements. In this manner the fastening components may be slid over the tongue portion of the tabs to secure the component in place and prevent rotation thereof during assembly. The fastening aperture 30 is constructed and arranged to align with at least one fastening aperture of an adjacent flotation element for assembly. Fasteners well known in the art, e.g. threaded or bayonet type, may be inserted through the tab apertures for assembly.

Figure 5:
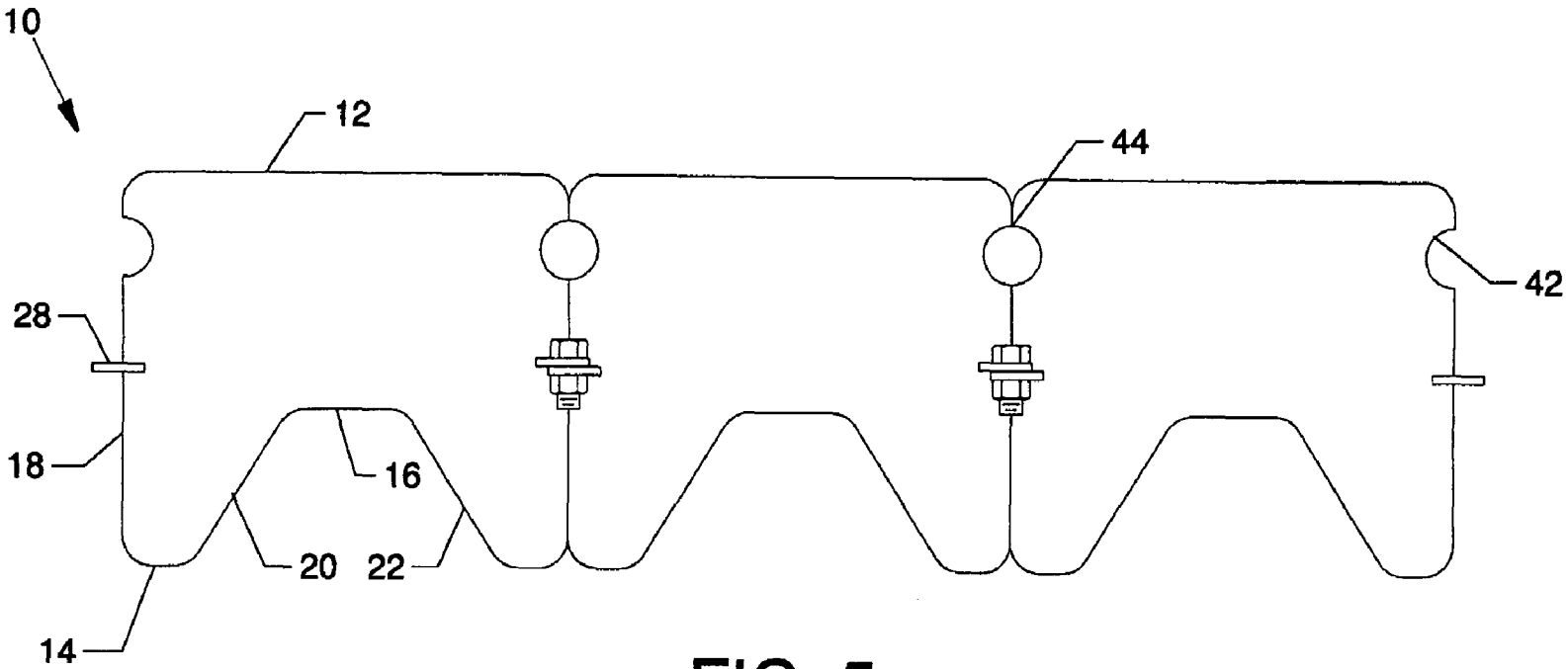
FIG. 5 is an end view illustrating one assembly embodiment of the instant invention.

Referring to FIG. 5, an assembly of three multidirectional floatation elements 10 having their first surface 12 uppermost are illustrated. In this embodiment each of the individual floatation elements 10 include at least one and preferably two integrally formed semi-circular conduits 42 extending the length of the floatation element 10 along the side walls 18. The semi-circular conduit is positioned to cooperate with semi-circular conduits of adjacent floatation elements to create a generally circular conduit 44 extending through the assembly. The circular conduit 44 is adapted for providing a pathway for service utilities throughout adjacent assembled floatation elements. In this manner service utilities such as electricity and water as well as conveniences such as fuel, compressed air or vacuum may be utilized throughout the assembled floatation elements. The conduits are preferably positioned along the sidewall evenly spaced between the first and the second surfaces allowing the conduits to be equally utilized regardless of the floatation element orientation. Alternatively, the conduits 42 may be positioned closer to the first surface 12 than to the second surface 14 or visa versa.

Figure 6:
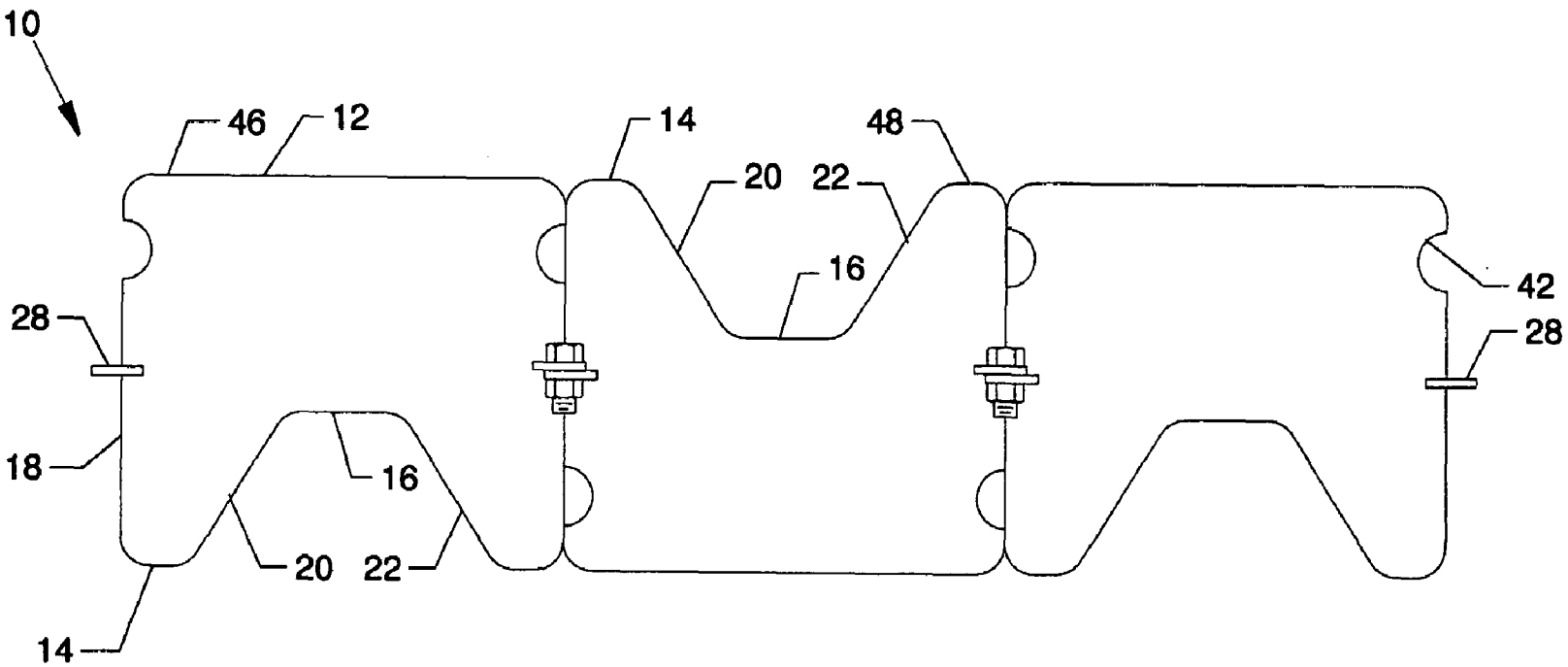
FIG. 6 is an end view illustrating one assembly embodiment of the instant invention.
Figure 7:
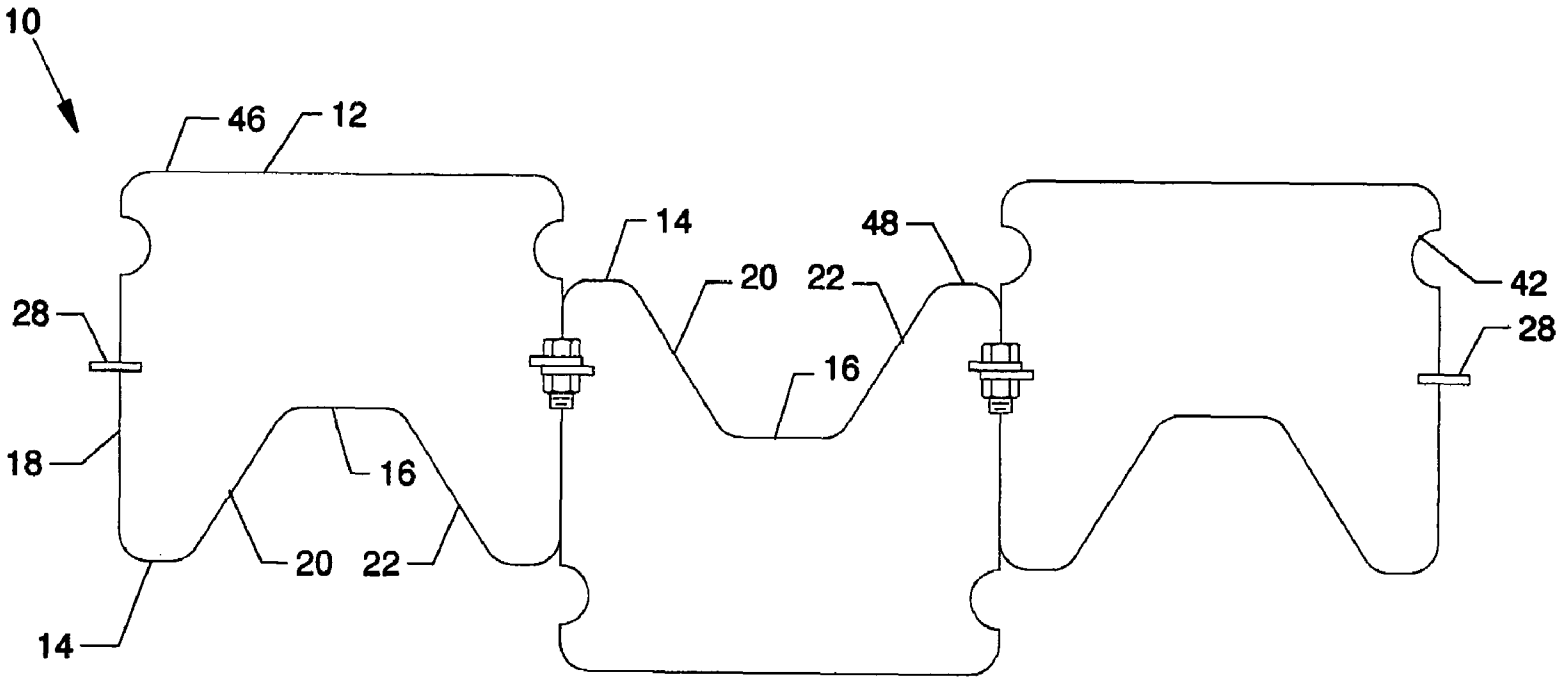
FIG. 7 is an end view illustrating one assembly embodiment of the instant invention.

Referring to FIGS. 6 and 7, an assembly of three multidirectional floatation elements 10 is illustrated, the outer elements having their first surface 12 uppermost and the center element having its second guiding surface uppermost. FIG. 6 illustrates the relative position of the adjacent uppermost surfaces when the tabs are positioned generally at the center portion of the sidewalls 18. FIG. 7 illustrates the relative position of adjacent uppermost surfaces when the tabs are positioned closer to the second surface 14 than to the first surface 12. It should be appreciated that because the tabs flex, varying the space between adjacent floatation elements or altering the tab 28 placement alters the flexing characteristics of the assembled floatation elements 10. In the preferred embodiment the tabs are about 4⅛ inches in length and about 5 inches below the first surface.

It should also be appreciated that the multidirectional floatation elements may be formed in various other polygonal shapes that are adapted to fit together suitably for use as floating walkways, docks or decks without departure from the scope of the invention. Some of these shapes may include, but should not be limited to rectangles, squares, pentagons, hexagons, octagons and the like.

Figure 8:
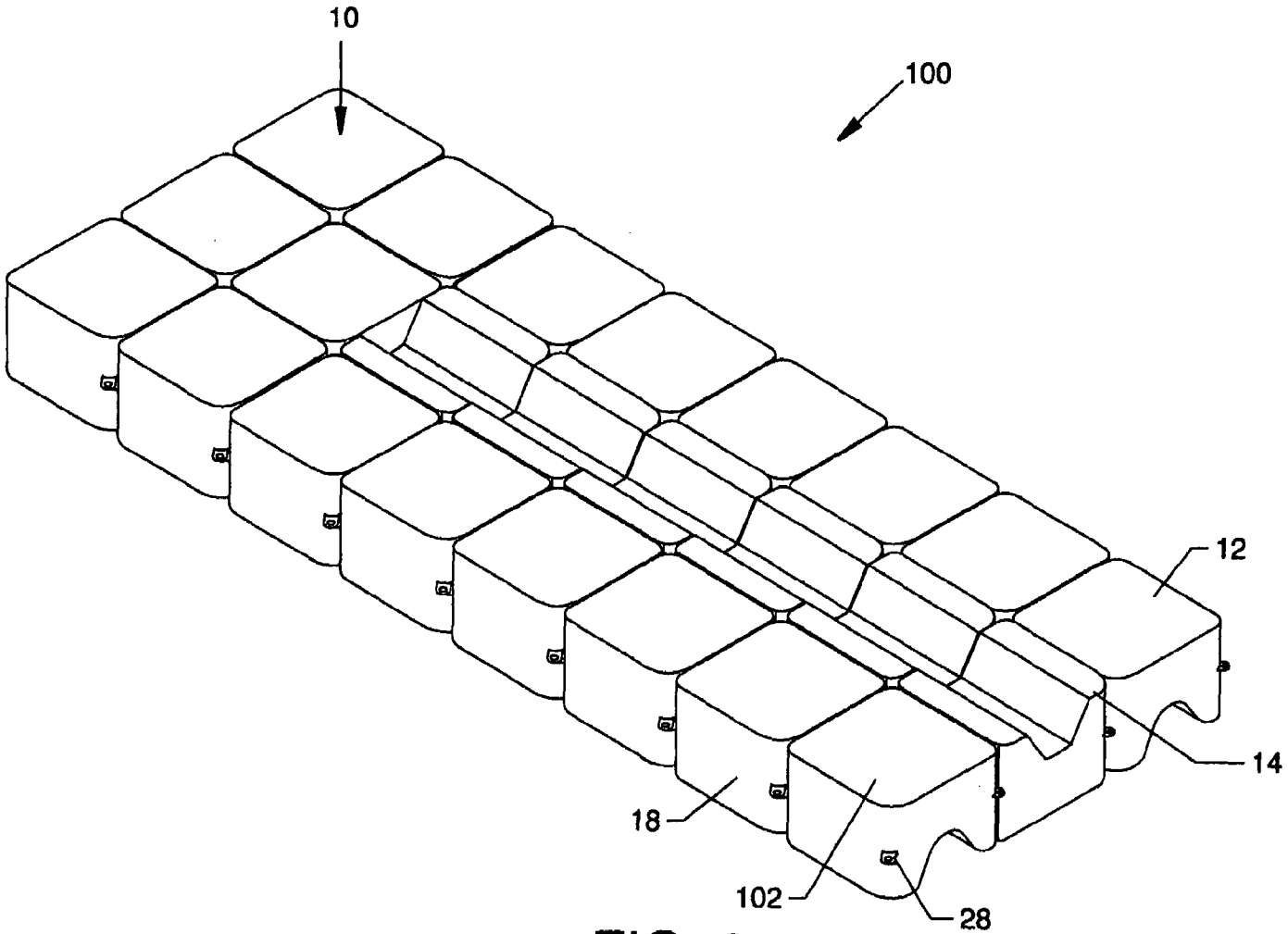
FIG. 8 is a pictorial view of a drive-on dock constructed using the multidirectional floatation elements of the instant invention.

Referring to FIG. 8, a floating drive-on dock 100 constructed from a plurality of multidirectional floatation elements 10 is illustrated. The tabs 28 are positioned on the sidewalls 18 of the floatation elements so that the uppermost surfaces form a generally planer surface with a V-shaped keel guide extending generally along the centerline of the drive-on dock. The drive-on dock is preferably constructed of a plurality of multidirectional floatation elements 10 having the same general size with a portion of the floatation elements being positioned with their first surface 12 uppermost and a portion of the floatation elements positioned with the second surface 14 uppermost. In an alternative embodiment the floatation elements at the distal end 102 may be smaller in size or may include ballast to lower the profile of the distal end of the drive-on dock 100.

Figure 9:
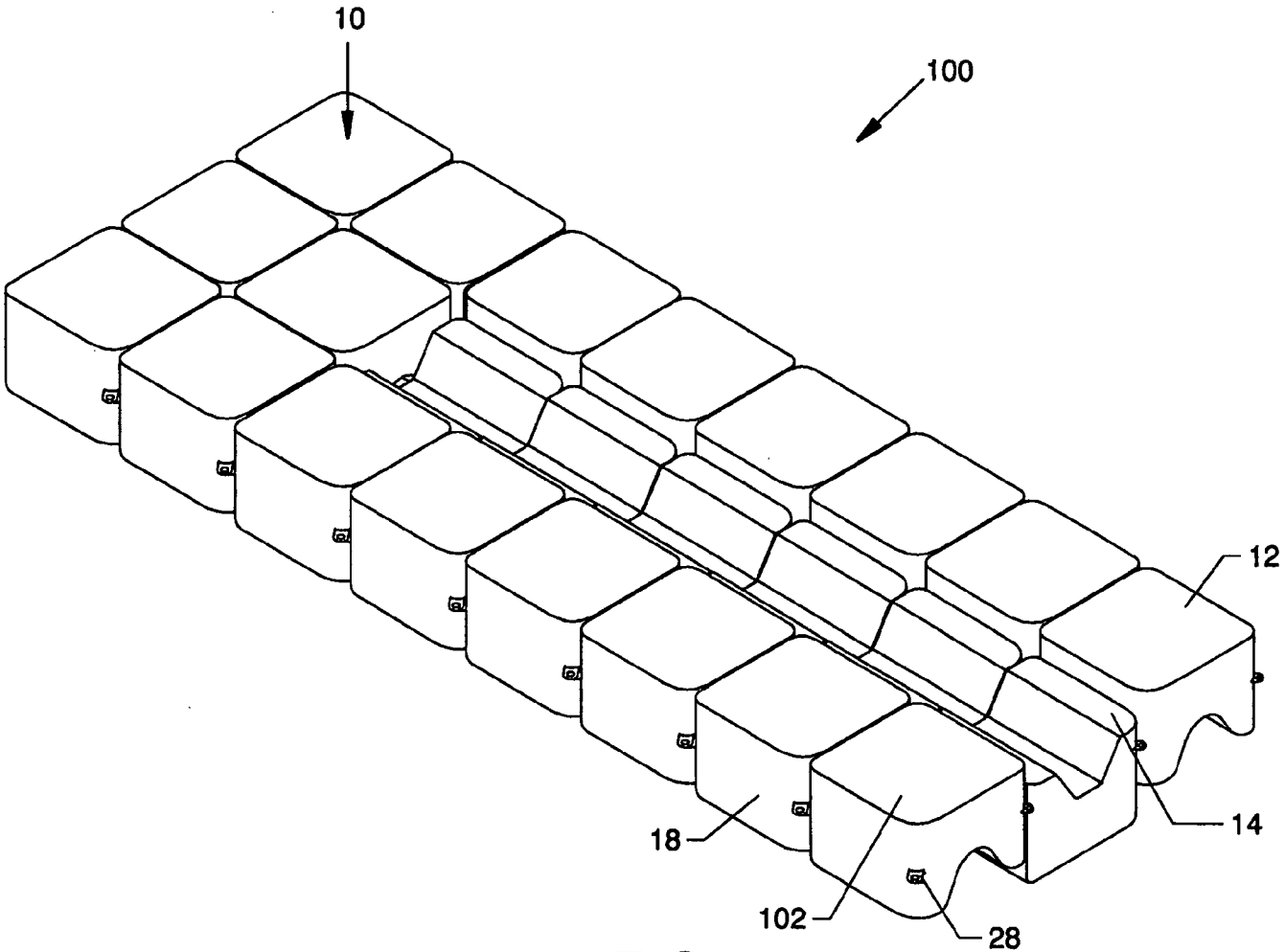
FIG. 9 is a pictorial view of a drive-on dock constructed using the multidirectional floatation elements of the instant invention.

Referring to FIG. 9, a floating drive on dock 200 constructed from a plurality of floatation elements 10 is illustrated. The tabs 28 are positioned on the sidewalls 18 of the floatation elements so that the uppermost surfaces 46 and 48 of the floatation elements 10 form stepped and generally parallel planer surfaces with a V-shaped keel guide extending generally along the centerline of the dock. The drive-on dock is preferably constructed of a plurality of floatation elements 10 having the same general size with a portion of the floatation elements being positioned with their first surface 12 uppermost and a portion of the floatation elements positioned with the second surface 14 uppermost.

This construction is particularly suited for applications requiring additional buoyancy and reduced flexing between the floatation elements. In an alternative embodiment the floatation elements at the distal end 202 may be smaller in size or may include ballast to lower the profile of the distal end of the drive-on dock 200.

Figure 10:
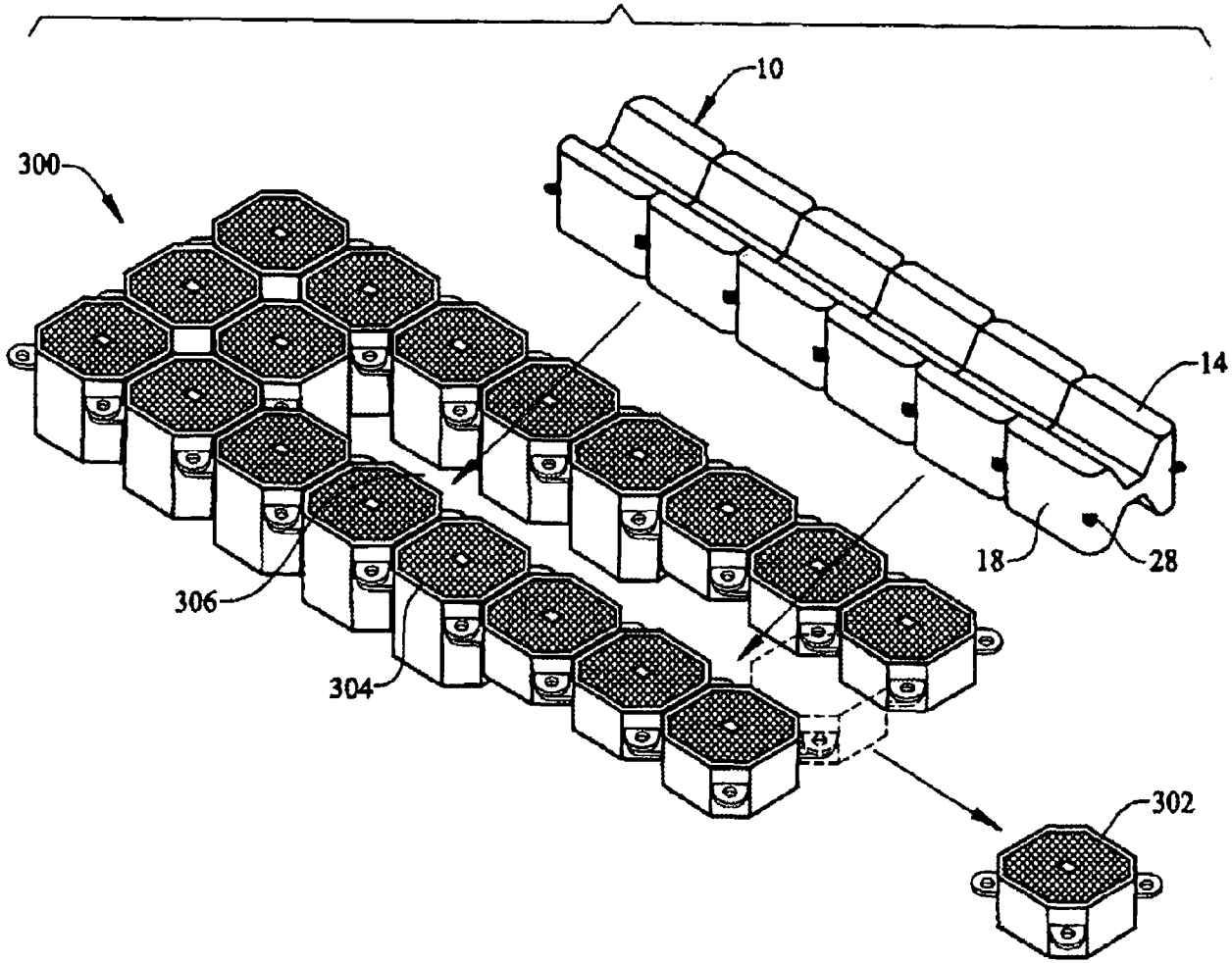
FIG. 10 is a pictorial view of the prior art and a pictorial view of a kit of the instant invention for filling in the open well of the prior art.

Referring to FIG. 10, a kit for filling the open well of the prior art drive on dry dock assembly 300 is illustrated. The kit includes at least one and preferably six multidirectional floatation elements 10. In operation, the connecting member 302 is removed from between the two extending arms 304 and the plurality of multidirectional floatation elements 10 are placed between the arms 304 and secured thereto using the tabs 28. The multidirectional floatation elements 10 are preferably positioned having their guiding surface uppermost. In this manner the open well 306 of the prior art is filled to provide a safer drive-on dock that can also be used as a deck or walkway. In addition, improved keel guiding and buoyancy is provided to boats being driven onto the dock.

Figure 11:
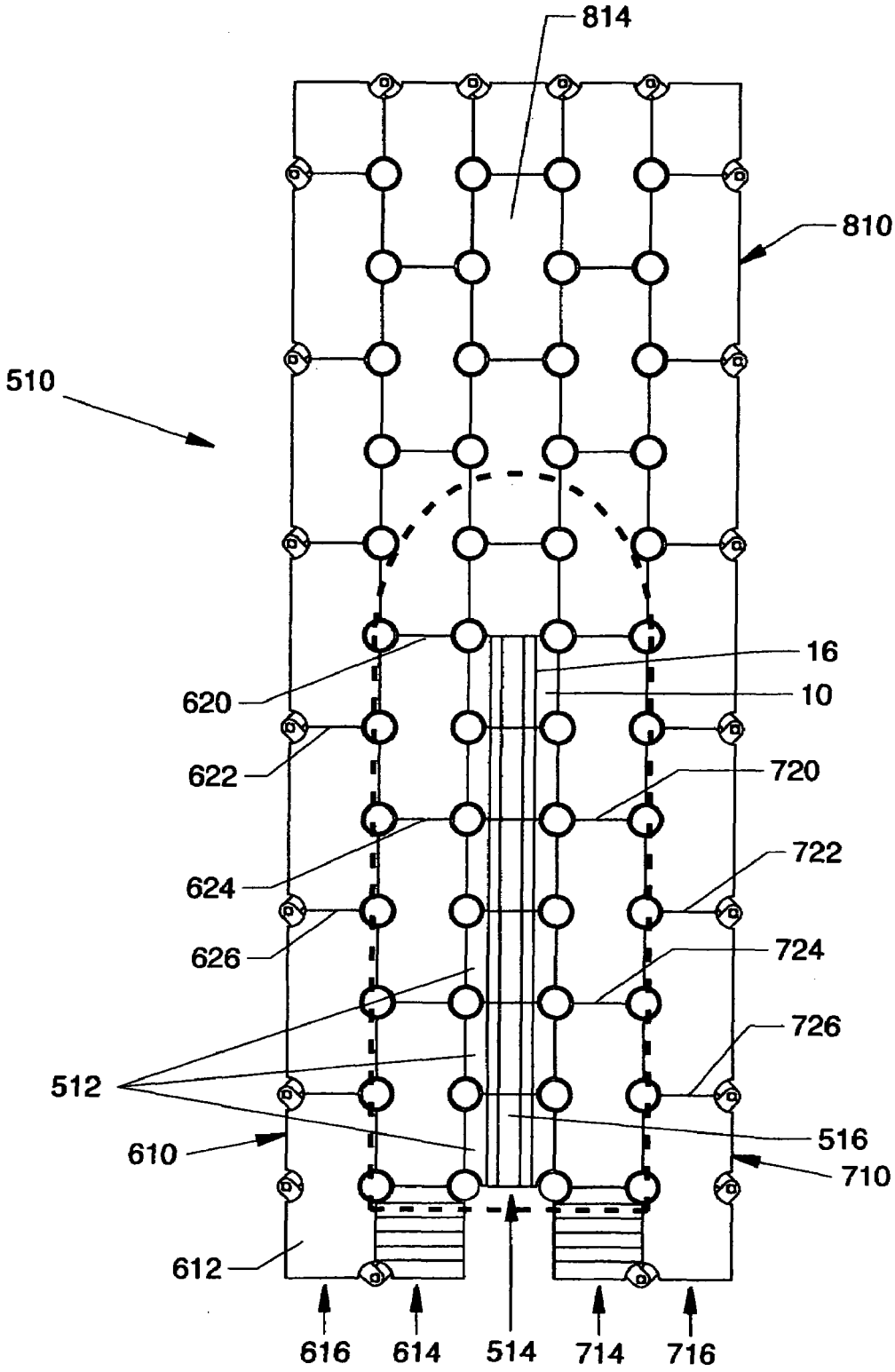
FIG. 11 is a schematic plan view of an assembly of the alternative embodiment.

In another embodiment, the earlier described multidirectional floatation element 10, may be oriented with the channel 16 upwardly directed and floated in the water as part of an assembly 510, as shown schematically in FIG. 11. Multidirectional floatation unit 10, having channel 16 upwardly directed may serve as a keel guide and support float 512. (Alternatively, a keel guide and support float 512 may be another floatation units, whether square in plan profile or, alternatively, rectangular in plan profile, provided a longitudinally co-aligned groove for keel guiding and support purposes can be established between such floatation units. In other words, although for ease of explanation and to facilitate understanding, the remaining description will focus upon a keel guide and support 514 formed from a plurality of the earlier described multidirectional flotation units 10 serving as keel guide and support floats 512, the invention is not to be regarded as requiring the specific multidirectional flotation unit 10, but rather any possible floatation unit from which can be formed a keel guide and support 514 with a longitudinally oriented groove or keel guide and support channel 516.) In the assembly 510, channel 16 is co-aligned throughout a plurality of longitudinally oriented and connected like members of keel guide and support floats 512. The keel guide and support floats 512, when connected with channels 16 co-aligned thereby form a keel guide and support 514. The keel guide and support 514 includes a keel guide and support channel 516, longitudinally oriented and defined by the co-aligned channels 16 of the connected keel guide and support floats 512. The keel guide and support 514 has a longitudinal extent and a transverse extent. Typically, as indicated in ghost outline in FIG. 11, a watercraft carried in the berth would be oriented longitudinally with its beam oriented transversely and keel longitudinally oriented and supported by the keel guide and support channel 516. The individual keel guide and support floats 512 contribute buoyancy to support a watercraft keel and lift an appropriately sized watercraft above water. Preferably, the keel guide and support 514 allows but is not limited to drive-on berthing of a watercraft onto the berth position, indicated schematically by the ghost outline. The keel guide and support 514 is parallel to and interposed between and connected to a first berth side run 610 and a second berth side run 710. Within each berth side run 610 and 710 are a plurality of rectangular float modules 612. The rectangular float modules 612 are organized and arranged in at least two longitudinally oriented courses 614 and 616 of the first berth side run 610 and courses 714 and 716 of second berth side run 710. In each of these courses 614, 616, 714 and 716, the rectangular float modules 612 are joined in end-to-end junctions 620, 622, 624, 626, and 720, 722, 724, 726, as will be discussed subsequently. Note that as shown schematically in FIG. 11, the end-to-end junctions of one course are longitudinally offset from and not aligned with the end-to-end junctions of the adjoining course. For example, end-to-end junctions 620 and 622 of course 614 do not align and are longitudinally offset from end-to-end junctions 624 and 626 of adjoining course 616 of the first berth side run 610.

Further, the first and second berth side runs 610 and 710 and keel guide and support 514 are connected to a platform 810. The platform 810 also preferably includes a plurality of rectangular float modules 612. Preferably, the rectangular float modules 612 within the platform 810 are also organized in longitudinally oriented courses which are continuances of earlier discussed longitudinally directed and longitudinally offset courses 614, 616, 714 and 716 extending from first and second berth side runs 610 and 710. Further, an additional course 814 specific to the platform 810 has the same relationship of longitudinal offset with respect to the courses 614, 616, 714 and 716 extending into the platform 810 from the first and second berth side runs 610 and 710. The assembly 510, as schematically depicted in FIG. 11, and when prepared with six keel guide and support floats 512, and more specifically in the form of the multidirectional flotation unit 10, along with berth side runs having two courses of rectangular float modules 612 compatible with the multidirectional floatation units 10 would be appropriate to support a small boat of about 13 feet length and about 5 feet beam and a capacity not exceeding about 1500 pounds.

Figure 12:
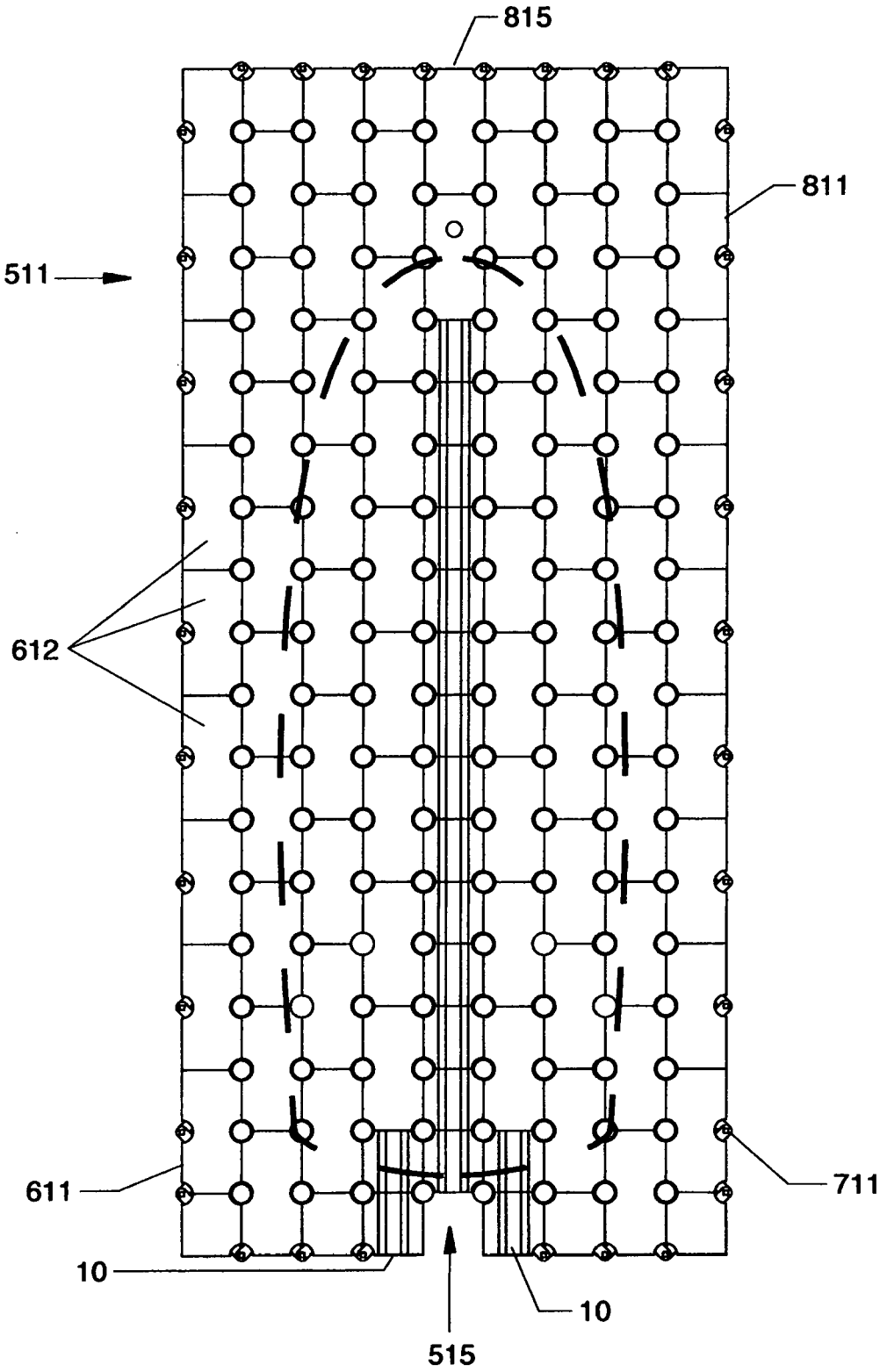
FIG. 12 is a schematic plan view of another assembly of the alternative embodiment; and, FIG. 13 is a partial pictorial view of a rectangular float module component of an assembly of FIGS. 11 and 12.

As shown in FIG. 12, larger assemblies, for example, assembly 511, may also be prepared. The assembly 511 has a keel guide and support 515 of fourteen keel guide and support floats 512, specifically multidirectional floatation unit 10, with co-aligned channels 16. (Again, the invention is not to be viewed as focused upon the specific multidirectional flotation unit 10 which is used herein to facilitate description, but rather with a focus upon the keel guide and support 515 which could be formed from other float units including square or rectangular as long as a co-aligned and longitudinal groove or channel can be provided to guide and support a watercraft keel.) First berth side run 611 and second berth side run 711 each have four longitudinally directed and longitudinally offset courses of rectangular float modules 612. End-to end junctions are not aligned with end-to-end junctions in adjoining courses. The courses of each of the first berth side run 611 and the second berth side run 711 continue into the platform 811 and include a course 815 interposed therebetween and having a longitudinally offset relationship to all the courses continuing from the first berth side run 611 and all the courses continuing from the second berth side run 711. The assembly 511 schematically depicted would be appropriate for medium sized boats of about 25 foot in length and beams on the order of 8 or 10 feet and about 5000 pounds. Such a medium sized boat is indicated in ghost outline of a berthing position is shown upon assembly 511 in FIG. 12. Additionally, provided that the essential features of the main assembly subcomponents, in particular, the keel guide and support 515 and the berth side runs 611 and 711 with longitudinally offset courses of rectangular float modules 612 are retained, it is also possible to supplement the assembly by utilizing additional float units such as, by way of example only, multidirectional float units 10, in other capacities, with the assembly 511. For example, note that one course of both first berth side run 611 and second berth side run 711 situated adjacent the keel guide and support 515 are each terminated with two keel guide and support floats 512, in the form of multidirectional float units 10. In this situation, such multidirectional float units 10 have an intermediate or shorter stance or top surface height relative to the water and the height of the top surfaces of the berth side runs and platform and thereby ease entry of a boat bow onto the assembly 511. It should be still understood, however, that the berth side runs should have at least two courses (as previous shown with FIG. 11), but three courses, four courses (as shown in FIG. 12) or even more courses will increasingly provide the benefit from employing a longitudinal offset relationship between courses.

Figure 13:
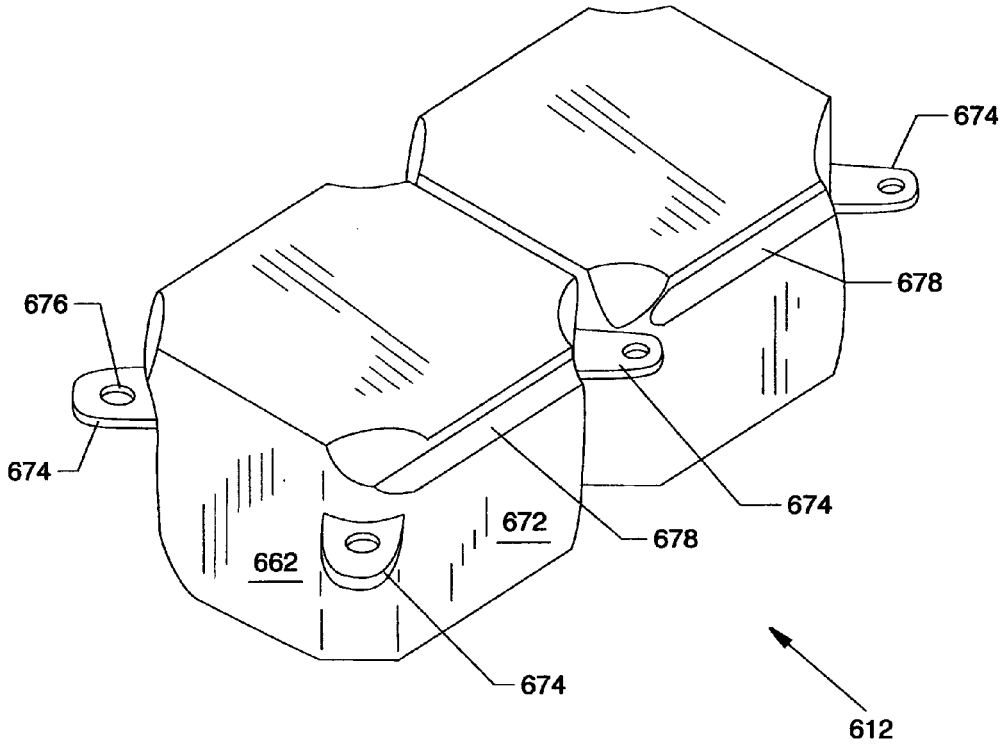

As shown in FIG. 13, a suitable rectangular float module 612, includes two ends 662 with a length extending horizontally between the ends 662, and two sides 672 with a width extending between the sides 672. The length is preferably about twice the width and most preferably, the width is about 19 inches and the length is about 38 inches. Such rectangular float modules 612 are formed in the same manner and from the same materials as the multidirectional float units 10. Preferably, the height of the rectangular float module 612 is greater than that of the multidirectional float module 10. Preferably, the rectangular float module 612 has a 2:1 ratio of length to width has a lower body with two chambers, more preferably each chamber is similar chamber contour. Preferably, the upper surface appears to have two generally square walking areas which convey an impression of being two connected individual cube-like float units within an assembly. This serves both an aesthetic purpose and the functional purpose of not distracting a person walking upon a platform incorporating such integer ratio rectangular float modules. Preferably, a semi-cylindrical channel 678 extends horizontally along upper portions of both rectangular sides 672 above three tabs 674. Side-to-side linking creates a full cylindrical channel which can be used to carry utilities and/or receive a pipe or like means to still further regulate and reduce flexing. This full cylindrical channel is preserved when two courses are joined in either longitudinally aligned or longitudinally offset relationships. Six tabs 674 extend and project horizontally from the four corners of rectangular float module, defined by the intersection of the sides 672 and ends 662 and two tabs originating and projecting from amid the center of the sides 672. Each tab 674 has an aperture 676 for connection to other rectangular float modules and to multidirectional float units 10. The spacing between a corner tab 674 and a tab 674 originating amid a side 672 is the same as tabs 674 originating at corners on an end 662, as well as on a multidirectional float unit 10. An end-to-end junction between one end 662 and a like end 662 of another rectangular float module has more flex than does an individual rectangular float unit 612 between its two mid side originating tabs. Thus, a staggered or longitudinally offset relationship between two courses of longitudinally oriented rectangular float units with end-to-end joins becomes more rigid, and in particular substantially more rigid than a single course. With respect to a single course it should be noted that flexing at an end-to-end junction is partially inhibited and limited by the portions of the ends 662 lying above and below the tabs 674. Because such portions interfere with each other during flexing at the end-to-end junction, the extent of flex is limited. In the particular case of end-to-end junctions between rectangular float modules such as 612, the lower portions contact each other at a lower angle than do the upper portions, above tabs 674. Thus, a course of end-to-end joined rectangular float modules 612 will tend to flex in a first (for example, concave) manner more than in a second (for example, convex) manner. In contrast, multidirectional float units 10, joined in a similar manner and with groove 16 upwardly directed and co-aligned, tend to flex in a second (for example, convex) manner due to interference between adjoining members first occurring above the tabs 28 in such orientation and coupled arrangement. Linking berth side runs with longitudinally offset courses of rectangular float modules to such a group of multidirectional float units serves to impart additional stability and rigidity to the entire resulting assembly and limits the tendency of the keel guide and support to undergo second (for example, convex) manner of flexing.

As mentioned earlier, other rectangular float modules might be formed have integer ratios of length to width of 3:1 and 4:1. In such cases, it would be preferable to have dimensions of about 57 inches by about 19 inches and 76 inches by about 19 inches respectively. More preferably, the 3:1 ratio rectangular float module would have four corner tabs, each with an aperture, and two additional tabs, each with an aperture, on each side, distributed ⅓ of the length and ⅔ of the length, for a total of eight tabs to facilitate connection with the spaced apart corner tabs of the multidirectional float unit 10, such that three multidirectional float units 10 might be joined to each side and one multidirectional float unit 10 to each end. More preferably, the 4:1 ratio rectangular float module would have four corner tabs, each with an aperture, and three additional tabs, each with an aperture, on each side, distributed ¼ of the length, ⅔ of the length and ¾ of the length, for a total of ten tabs to facilitate connection with the spaced apart corner tabs of the multidirectional float unit 10, such that four multidirectional float units 10 might be joined to each side and one multidirectional float unit 10 to each end. Preferably, the rectangular float modules of 3:1 and 4:1 ratios of length to width have lower bodies with three and four chambers, respectively, and more preferably, each chamber has a similar chamber contour. Preferably, the upper or walking surfaces appears to have three or four square areas, respectively, which convey an impression of being three or four connected individual float units within an assembly. This serves both an aesthetic purpose and the functional purpose of not distracting a person walking upon a platform incorporating such integer ratio rectangular float modules. It will of course be recognized that sizing of all the parts and sub-parts of the present invention may be scaled up or down without altering the essential nature of the more rigid berth assembly of this invention.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

Those of ordinary skill will further recognize that various modifications can be made to the present invention without departing from the spirit of the invention.

I claim:

1. A floating berth modular dock system assembly comprising:

a first berth side run, the first berth side run having a longitudinal extent and a transverse extent, the first berth side run including a plurality of rectangular float modules, each of the rectangular float modules having two sides with a horizontally oriented width therebetween and two ends with a horizontally oriented length therebetween, the horizontally oriented length exceeding the horizontally oriented width, the plurality of rectangular float modules organized in at least two longitudinally directed courses of rectangular float modules, each longitudinally directed course of the at least two longitudinally directed courses having adjoining rectangular float modules joined by end-to-end junctions, each of the at least two longitudinally directed courses being parallel to and longitudinally offset from adjoining courses, such that end-to-end junctions in one course do not align with end-to-end junctions in adjoining courses; and, a keel guide and support, the keel guide and support having a longitudinal extent and a horizontal extent, the keel guide and support including a plurality of modular keel guide and support floats joined in a longitudinally co-aligned orientation, the keel guide and support connected to the first berth side run with the longitudinal extent of the keel guide and support oriented parallel to the longitudinal extent of the first berth side and wherein each of the modular keel guide and support floats includes an upwardly directed keel guiding and supporting surface with a keel guide and support channel extending thereacross, and wherein the modular keel guide and support floats are longitudinally co-aligned and joined such that the keel guide and support channels together define a longitudinal keel guide and support channel extending longitudinally along the keel guide and support.

2. The floating berth modular dock system assembly of claim 1 and further comprising:

a second berth side run, the second berth side run having a longitudinal extent and a transverse extent, the second berth side run including a plurality of rectangular float modules, each of the rectangular float modules having two sides with a horizontally oriented width therebetween and two ends with a horizontally oriented length therebetween, the horizontally oriented length exceeding the horizontally oriented width, the plurality of rectangular float modules organized in at least two longitudinally directed courses of rectangular float modules, each longitudinally directed course of the at least two longitudinally directed courses having adjoining rectangular float modules joined by end-to-end junctions, each of the at least two longitudinally directed courses being parallel to and longitudinally offset from adjoining courses, such that end-to-end junctions in one course do not align with end-to-end junctions in adjoining courses, the longitudinal extent of the second berth side run oriented parallel to the longitudinal extents of the first berth side run and the keel guide and support, with the keel guide and support interposed between the first berth side run and the second berth side run.

3. The floating berth modular dock system assembly of claim 2 and further comprising:

a platform, the platform connected to the first berth side run, the second berth side run and the keel guide and support interposed between the first berth side run and second berth side run.

4. The floating berth modular dock system assembly of claim 3 and wherein the platform includes a plurality of modular rectangular floats and further wherein the at least two longitudinally directed and longitudinally offset courses of modular rectangular floats of at least one of the first berth side run and the second berth side run extend into the plurality of modular rectangular floats of the platform.

5. The floating berth modular dock system assembly of claim 4 and further wherein the at least two longitudinally directed and longitudinally offset courses of both the first berth side run and the second berth side run extend into the modular rectangular floats of the platform and further wherein the platform includes at least one additional course of longitudinally offset rectangular float modules interposed between and longitudinally offset relative to the at least two longitudinally directed courses extending from the first berth side run and the at least two longitudinally directed courses extending from the second berth side run.

6. The floating berth modular dock system assembly of claim 2 and wherein at least one of the first berth side run and the second berth side run include at least three longitudinally directed courses of rectangular modular floats, each of the at least three longitudinally directed courses longitudinally offset relative to adjoining longitudinally directed courses.

7. The floating berth modular dock system assembly of claim 1 and further wherein the longitudinal keel guide and support channel has a lower horizontally oriented planar surface and paired planar surfaces diverging upwardly and outwardly at predetermined angles from the lower horizontally oriented planar surface.

8. The floating berth modular dock system assembly of claim 1 and wherein the rectangular floats have a ratio of about 2:1, 3:1 or 4:1 between the horizontally oriented length and the horizontally oriented width.

9. The floating berth modular dock system of claim 8 and wherein each of the modular keel guide and support floats has four sides and a horizontally oriented extent in both width and length similar to the horizontally oriented width of the rectangular float modules.

10. The floating berth module dock system assembly of claim 9 and wherein the modular keel guide and support floats and the rectangular float modules each have, respectively, horizontally oriented extents of about 18 to about 20 inches.

11. The floating berth modular dock system assembly of claim 1 and wherein the rectangular floating modules and the modular keel guide and support floats each include horizontally projecting tabs, each projecting tab having at least one aperture, and extending generally from corners of the rectangular floating modules and the modular keel guide and support floats so as to allow formation of junctions connecting rectangular float modules and modular keel guide and support floats.

12. The floating berth modular dock system assembly of claim 11 and further wherein the rectangular floating modules have at least one horizontally projecting tab having at least one aperture extending, between the ends of rectangular module, from a side of the rectangular floating module so as to allow formation of junctions connecting rectangular floating modules and modular keel guide and support floats.

13. A floating berth modular dock system assembly comprising:

a first side run, including a plurality of rectangular float modules;

a second side run, including a plurality of rectangular float modules;

a keel guide and support, including a plurality of keel support and guide floats, interposed between the first and second side run; and, wherein the first and second side runs are each characterized, when separated from the assembly, by a greater tendency to longitudinally concave flex than to longitudinally convex flex and the keel guide and support is characterized, when separated from the assembly, by a greater tendency to longitudinally convex flex than to longitudinally concave flex, and wherein the assembly is characterized by the lesser of longitudinal flex in both concave flex and convex flex not greater than the lesser of, when separated from the assembly, the first and second side runs and the keel guide and support and wherein the first and second side runs each have a longitudinal extent and a transverse extent, and wherein each of the rectangular float modules has two sides with a horizontally oriented width therebetween and two ends with a horizontally oriented length therebetween, the horizontally oriented length exceeding the horizontally oriented width, the plurality of rectangular float modules organized in at least two longitudinally directed courses of rectangular float modules joined by end-to-end junctions of adjoining rectangular float modules of the course, the at least two longitudinally directed courses being parallel to and longitudinally offset from each other, such that end-to-end junctions in one course do not align with end-to-end junctions in an adjoining other course.

14. The floating berth modular dock system assembly of claim 13 and wherein the rectangular float modules have a ratio of about 2:1, 3:1 or 4:1 between the horizontally oriented length and the horizontally oriented width.

15. The floating berth modular dock system assembly of claim 14 and wherein the rectangular float modules have a horizontal projecting tab on each intersecting corner of the sides and the ends and at least one horizontal projecting tab on each side between the ends, which corner projecting tabs and at least one side projecting tabs each has an aperture for coupling to other modules and floats of the assembly.

16. A method of assembling a floating berth modular dock system, the method comprising the steps of:

providing a plurality of rectangular float modules, each module having two ends with a horizontally oriented length therebetween, two sides with a horizontally oriented width therebetween, a ratio of about 2:1 of the horizontally oriented length to the horizontally oriented width, and a horizontally projecting tab with an aperture at the intersecting sides and ends and a horizontally projecting tab with an aperture about midway on each side and further providing a plurality of keel guiding and supporting floats, each keel guiding and supporting float having four sides with a horizontal extent therebetween similar to the horizontally oriented width of the rectangular float modules, an upwardly directed keel guiding and supporting surface with a keel guide and support channel extending longitudinally thereupon, the longitudinal keel guide and support channel having a lower horizontally oriented planar surface and paired planar surfaces diverging upwardly and outwardly at predetermined angles from the lower horizontally oriented planar surface, a horizontally extending tab and aperture projecting from each intersecting corner of two adjoining sides, and additionally providing a plurality of fasteners for insertion through the apertures to connect tabs of two, three or four of the rectangular float modules and/or the keel guiding and supporting floats; and, assembling the rectangular float modules and the keel guiding and supporting floats into a first berth side run with a longitudinal extent and a transverse extent, a second berth side run with a longitudinal extent and a transverse extent, and a keel guide and support; with a longitudinal extent and a transverse extent, interposed between the first berth side run and the second berth side run, wherein the channels of the modular keel guide and support floats are longitudinally co-aligned and joined such that the keel guide and support channels together define a longitudinal keel guide and support channel extending longitudinally along the keel guide and support; and wherein each of the berth side runs includes at least two courses of rectangular float modules organized in longitudinally directed courses of rectangular float modules, each longitudinally directed course of the at least two longitudinally directed courses having adjoining rectangular float modules joined by end-to-end junctions, each of the at least two longitudinally directed courses being parallel to and longitudinally offset from adjoining courses, such that end-to-end junctions in one course do not align with end-to-end junctions in adjoining courses.

17. The method of assembling a floating berth modular dock system of claim 16 and wherein the first berth side run and the second berth side run are pre-assembled and the keel guiding and support is subsequently interposed between the first berth side run and the second berth side run.

18. The method of claim 17 and wherein the first berth side run and second berth side run are attached to a platform.

* * * * *